US006382947B1

(12) United States Patent
Bryant

(10) Patent No.: US 6,382,947 B1
(45) Date of Patent: May 7, 2002

(54) COLOR BLENDING APPARATUS

(75) Inventor: Edward J. Bryant, Toronto (CA)

(73) Assignee: Hengestone Holdings, Inc., Georgetown (CA)

( * ) Notice: Subject to any disclaimer, the term of this patent is extended or adjusted under 35 U.S.C. 154(b) by 49 days.

(21) Appl. No.: 09/644,040

(22) Filed: Aug. 22, 2000

Related U.S. Application Data

(63) Continuation-in-part of application No. 09/198,645, filed on Nov. 24, 1998, now abandoned.

(51) Int. Cl.[7] ..... B28B 13/00

(52) U.S. Cl. ..... 425/130; 425/258; 425/260; 425/448

(58) Field of Search ..... 425/130, 134, 425/145, 253, 254, 255, 256, 257, 258, 432, 456, 448, 260; 366/68, 189, 192

(56) References Cited

U.S. PATENT DOCUMENTS

| | | | | | |
|---|---|---|---|---|---|
| 861,903 | A | * | 7/1907 | Rosell | 425/257 |
| 1,919,807 | A | * | 7/1933 | Sharpe | 425/263 |
| 2,208,054 | A | * | 7/1940 | Reed | 425/130 |
| 2,442,517 | A | * | 6/1948 | Slaton | 425/253 |
| 3,296,675 | A | * | 1/1967 | Filangeri | 425/130 |
| 3,425,105 | A | * | 2/1969 | Gulde | 425/448 |
| 3,625,490 | A | * | 12/1971 | Hummelshoj | 366/42 |
| 3,655,318 | A | * | 4/1972 | Schneider et al. | 425/256 |
| 3,809,516 | A | * | 5/1974 | Komaki | 425/150 |
| 3,939,238 | A | * | 2/1976 | Salts | 264/245 |
| 3,955,907 | A | * | 5/1976 | Yamasita et al. | 425/130 |
| 4,153,401 | A | * | 5/1979 | Longinotti | 425/130 |
| 4,966,463 | A | * | 10/1990 | Hihara et al. | 366/14 |

* cited by examiner

*Primary Examiner*—Robert Davis
(74) *Attorney, Agent, or Firm*—Perkins, Smith&Cohen; Jerry Cohen

(57) ABSTRACT

An apparatus for color blending an agglomerating flowable material from a differently colored individual batches, to mold a mottled heterogeneous product with material from at least two batches so that mottled products (i.e. with irregular arrangement of spots or confluent blotches of color) are produced from a relatively dry concrete mixture (zero slump concrete), which agglomerates into clumps that tumble randomly from individual hoppers containing individually colored concrete batches. By controlling positioning of a filling tray relative to a hopper outlet, the time sequencing and quantity of material released from each hopper outlet, it is possible to fill the filling tray in a large number of seemingly random mottled patterns where clumps of each of the individual colors remain visible in the molded product.

8 Claims, 3 Drawing Sheets

COLOR BLENDING APPARATUS

RELATED APPLICATIONS

This application is a continuation-in-part of U.S. patent application Ser. No. 09/198,645 filed Nov. 24, 1998 now abandoned entitled COLOR BLENDING APPARATUS.

TECHNICAL FIELD

The invention is directed to an apparatus and method for color blending differently colored batches of agglomerating flowable material together to fill a mold with a mottled heterogeneous charge including visible colored clumps of material from each colored batch.

BACKGROUND OF THE ART

A mottled, dappled or variegated random pattern is considered aesthetically pleasing in a number of applications providing a natural blended coloring. The irregular arrangement of blotches or patches of color in a multi-colored heterogeneous surface can be produced from flowable material which has been tumbled together or agglomerates naturally in a molding process.

In the specific example provided in the present description, a blended or mottled pattern is a desirable feature in the production of concrete paving stones and retaining wall blocks. In this art, using iron oxide pigments in the mix design of the concrete batch, the majority of paving stones and approximately one-half of retaining wall products are color blended.

In this art, the "blending" of colors as used in this description and in the trade does not relate to complete mixing that would produce a homogenous color composite of the two input colors. Rather the word "blending" relates to the mixing of two, three or sometimes four colored batches of concrete together such that the finished products contain distinct clumps or patches of each color consistently through the production of paving stones or retaining wall blocks.

An essential characteristic of such color blending is the consistency of distribution of each color used in the blending process throughout the production run. In the past, it has been extremely difficult to ensure consistency while retaining a random appearance to the finished product. Random mottling, with a consistent percentage of the surface area visible in each of the colors is the ideal. However, prior art systems are extremely dependent upon the skill of operators, result in wastage and unsatisfactory color blending in many cases. The capacity to produce a consistently blended product is advantageous in that wastage is reduced and the aesthetic appeal of the well blended product creates a significant market advantage.

Traditionally, because of the technical difficulties, most color blending has involved only two colors. The production of a consistently blended three color mottled pattern has involved extensive rework and generally unsatisfactory appearance in that the distribution of three colors is very sporadic and unpredictable. Mixing of four colors presents almost insurmountable difficulties for prior art systems. In many cases these difficulties can be addressed by manually mixing and laying the finished paving stones during installation with a trained eye to ensure even distribution of the different colors throughout the finished installation. A manual laying system increases labour costs and is generally inefficient in large areas where machined laying systems are preferred. In addition, the manual mixing of colored stones during installation relies heavily on the skill and perception of the installer.

In the past, color blending was carried out with a hopper having a separating bulkhead plate down the middle and filling the hopper with different colored materials on either side of the bulkhead dividing plate. A single gate at the bottom of the hopper was opened and blending of two colors occurred as both sides of the hopper were emptied simultaneously.

A refinement of this procedure included an upper hopper with a moveable plate gate serving as a funnel to feed a batch of colored material into either side of the lower divided hopper.

In the prior art, a concrete mixer was loaded with cement, pigment, sand and rock aggregate in the form of crushed stone chips or relatively small rocks, together with water and other admixtures to create a colored concrete batch. Once the raw materials are thoroughly mixed together, the mixer discharges the batch into the upper hopper and over the moveable plate to direct the flow of material into either side of the divided lower hopper. When the outlet for the lower hopper was opened, material from both sides of the hopper flowed out through the opening and tumbled together in a mottled blended charge into the mold.

There are several disadvantages to this prior art system. Firstly, when one side of the lower hopper is filled and other half of the lower hopper is empty, there is a significant amount of backflow from the filled side of the hopper to the unfilled side. As a result, the first portion of material which exits when the hopper is opened is a of single color. Generally, the first few fillings of the mold must be discarded since the aim is to produce a consistently colored mottled appearance using both colored batches.

In addition, since the extreme outward portions of the flow from the hopper are completely one color or the other, products produced in this manner generally have about 75% of the product blended in the central area of the mold, and the remaining outer 25% is evenly split between the two solid colors of the materials. Therefore, the degree of blending is satisfactory, but less than ideal, since a significant portion of the mold creates blocks that are a single solid color rather than dappled or mottled appearance as desired. These solid blocks can be distributed in the final installation, however with some skill on the part of the installer.

In prior art systems, the hopper does not drop material directly in to the mold, but rather the hopper deposits material into a filling tray. The material in the tray is agitated slightly to distribute material evenly and level the top surface, then the tray and material are transferred to a position above the mold. The filling tray has an open woven grate at the bottom and rests on a solid table during filling. An agitating grate distributes material and aids in the mixing of clumps of the different colored materials prior to depositing in the mold. When the filling tray is laterally shifted to above the mold, the relatively dry nature of the concrete mix and speed of lateral motion prevent the concrete from exuding through the bottom grating to any great extent. The mold and filling tray above it are then vibrated. Vibration agitates the thixotropic concrete mix in the filling tray to flow easily through the grating into the mold. The filling tray is removed, and a tamping head further vibrates and compacts the top surface of the material within the mold. Afterwards the mold and tamping head are withdrawn, and the finished blocks are conveyed away on a pallet.

This prior art system is generally accepted as the best that can be provided with existing equipment, however, the relatively large number of finished blocks of a single solid color with no blending of colors is a significant disadvantage. As well, the large amount of waste created when the first batch is dropped into one side of the hopper is disadvantageous, especially where a small production run or small number of batches is produced. With prior art systems, it is undesirable for a manufacturer to produce a short production run of blended product despite market demands since the wastage on starting up a production run becomes significant.

A further disadvantage of the split hopper prior art system is a slow cycle time and inefficient blending. Batches of colored material are gravity fed and ideally the amount of material stored in either side of the split hopper should be identical to result in the same quantity of flow when the clamshell gates are opened. However, since material is mixed in a single mixer, one color at a time, in general, the amount of material stored in one side of the split hopper will always be less than the amount of material stored in the other side. This results in uneven amounts of material flowing out when the hopper outlet is opened. For example, if one side of the hopper is full, the other side is almost empty awaiting refilling from the mixer, the volume of material flowing under gravity from the full side will be significantly greater.

It is generally undesirable to solve this problem by providing a larger sized hopper to store large quantities of wet materials, since the concrete mixture will set up and harden if not deposited in the mold within a limited period of time. It is not desirable therefore, for the dwell time of the wet concrete mix in the hopper to approach the setup time to avoid the difficulty of dealing with hardened material deposited within the equipment. In addition, the alternative of running mixers with less than a full batch load is inefficient economically and will slow down production.

The alternative of providing two more mixers is also not feasible economically. A mixer is an expensive capital item to purchase and operate. A mixer requires significant maintenance for proper operation and must be thoroughly cleaned after each production run. The additional cost of purchasing and operating separate mixer for each color generally cannot be passed on to the purchaser in the form of a significantly increased price for blended colored paving stones without detriment to the market for these products. A minor premium may be accepted, however, when significant production cost increases are experienced, in the form of additional equipment or slower production, these costs act to directly reduce the viability of the product line.

Problems with consistent mixing of various colors increase dramatically as the number of colors increase. For example, when three color blending is carried out in a two-part split lower hopper, the first batch is deposited in one side and the second batch deposited in the other side as explained above in respect of two color mixing. However, the third batch of a third color is then added to the same side of the hopper as the first batch. It takes a number of cycles before all three colors are seen exiting from the lower end of the hopper.

Significant wastage results on startup of production and it is extremely difficult to control the amount of each colored material which is being introduced into the filling tray. The skill of the mold press operator and experience accumulated over several trial and error attempts makes it never-the-less possible to produce a mottled three color blended product. However, the results are far from satisfactory and numerous complaints from purchasers are received since the colors are not evenly blended or sufficiently consistent.

Therefore, it is desirable to produce a system which allows for consistent color blending of two or more colored materials over a production cycle without the wastage or lack of consistency experienced with the prior art.

It is also desirable to provide a system where the blending of colors is predictable, consistent and reproducible through a single production run and between different production runs to ensure conformity of products to customer specifications.

It is highly desirable to provide a system where three, four or more different colors can be blended together consistently since this is practically impossible with prior art systems.

It is further desirable to produce a color blending system which can operate at the maximum speed of the molding press without prohibitively increased cost of equipment.

DISCLOSURE OF THE INVENTION

The invention provides a method and apparatus for color blending an agglomerating flowable material from a number of differently colored individual batches, such that a forming mold is filled with a mottled heterogeneous charge comprising material from at least two of the batches.

Differently colored batches of agglomerating flowable material are directed from a mixer to a like number of material storage hoppers each with an independently operable outlet. Once each hopper is initially filled, using sensing probes inside each hopper, the mixer continues to produce batches to maintain a sufficient amount of material in each hopper while the material flows out of the hoppers into the mold. Since each hopper has an independently operated outlet, differences in the volume of material in different hoppers can be compensated for and a predetermined volume of material can be dosed as required. Preferably the method includes a single mixer using a movable bucket operable between a loading position in communication with the mixer and a dumping position over a selected hopper.

Programmed controls directed by a computer for example then control the position relative to the mold, time sequencing and quantity of material passed through each hopper outlet to fill the mold with a mottled heterogeneous charge comprising material from at least two batches.

Preferably controls include indexing a filling tray to a number of selected tray filling positions relative to each hopper outlet. After being filled and levelled the filling tray is transferred to a mold filling position above the mold and the material is dropped into the mold.

A device for color blending includes at least two material storage hoppers each with an independently operable outlet, means to fill the hoppers directing a chosen colored batch of material from the mixer to a selected hopper, means to fill the mold, downstream from the hoppers, with material from at least two of the hoppers; and controls for controlling the position relative to the mold, time sequencing and quantity of material passed through each hopper outlet.

In the preferred example, the material is a relatively dry concrete mixture, known as zero slump concrete, which agglomerates into clumps that tumble randomly from the hopper outlets. By controlling the positioning of the filling tray relative to a selected hopper outlet, the time sequencing and quantity of material released from each hopper outlet, it is possible to fill the filling tray in a large number of seemingly random mottled patterns where clumps of each of the individual colors remain visible in the molded product. Although the mottled pattern appears random as is highly desirable, the distribution of color is controlled and can be rendered consistent within acceptable tolerances.

It is not desirable to produce identical mottled patterns in each charge delivered to the mold since the repeated identical pattern will be clearly apparent like a wallpaper pattern in the installation. The identical pattern would be particularly noticeable when blocks are installed by machine since the machine lays a complete layer course from a manufactured stack at one time. When laid by hand, there can be a degree of mixing that occurs if the installer randomly picks blocks from the stack, however this method relies on the knowledge and skill of the installer, and is prohibitively labour intensive on large projects.

A well blended stack of blocks should have a random appearance while including a consistent ratio of visible colored surfaces. The invention allows for a large number of variables in filling the mold so that a consistent random appearance is generated in a controlled manner. By programming the variance in the position, timing and volume of colored materials deposited from different hoppers, any number of different mottled patterns can be produced.

The natural characteristics of the material somewhat aid in producing a random mottled appearance since zero slump concrete for example will agglomerate into visibly sized clumps and will tumble in a gravity flow from the hopper outlet. The vibrating and tamping of this thixotropic material into the mold will merge the edges of the clumps together but will not substantially mix the bulk of differently colored clumps of materials together.

Further details of the invention and its advantages will be apparent from the detailed description and drawings included below.

BRIEF DESCRIPTION OF THE DRAWINGS

In order that the invention may be readily understood, one preferred embodiment of the invention will be described by way of example, with reference to the accompanying drawings wherein:

FIG. 3 is an elevated view of a conventional hopper with filling tray positioned beneath the clamshell hopper outlet, showing a first colored material deposited in an upper hopper and directed with a moveable swing gate to the left side of a divided lower hopper.

FIG. 4 shows the swing gate moved to a second position to load a second colored material in the upper hopper and directing it to a right side of the divided lower hopper, in particular showing the undesirable backflow of the first color into the bottom portion of the right side of the divided hopper.

FIG. 5 shows the method by which three colors of material are mixed showing the swing gate moved to the initial position again and depositing a third colored material in the upper hopper which proceeds by gravity flow with the other two colored materials into the filling tray when the clamshell hopper outlet is opened.

DETAILED DESCRIPTION OF PREFERRED EMBODIMENTS

Figure 5:
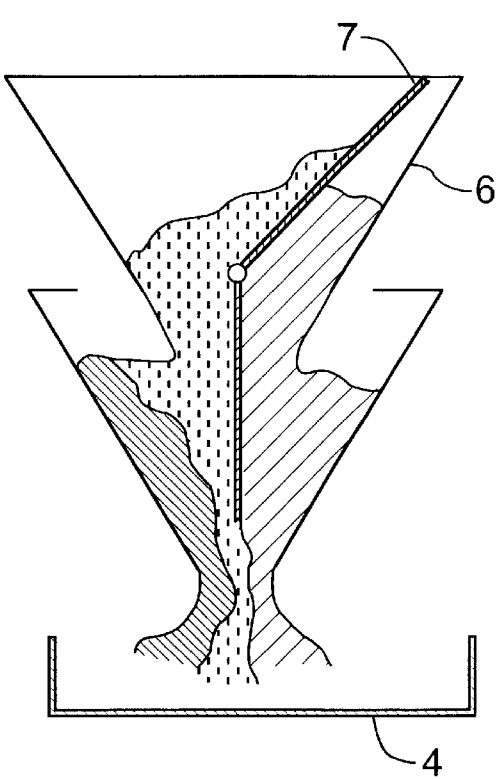
FIG.5 Prior Art
FIGS. 3, 4 and 5 illustrate a material storage hopper and method of producing a mottled charge in accordance with the prior art as follows.
Figure 4:
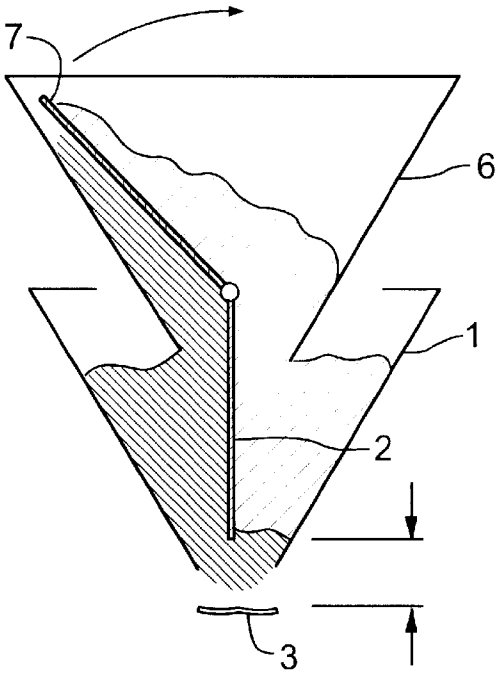
FIG.4 Prior Art
Figure 3:
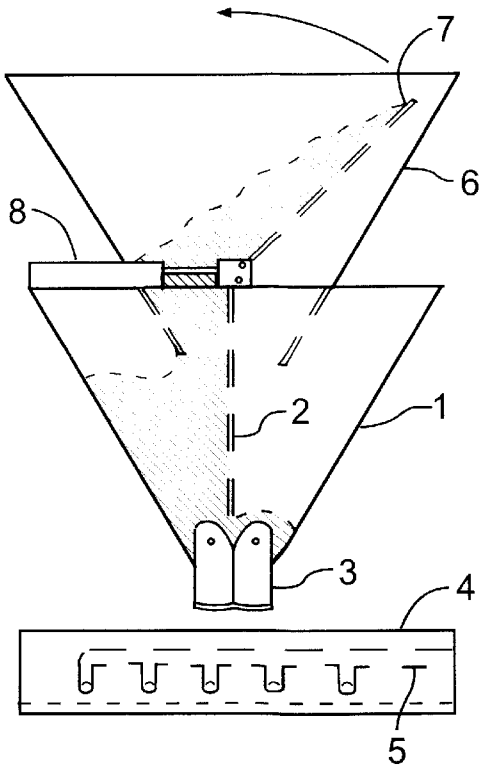
FIG.3 Prior Art

FIGS. 3, 4 and 5 illustrate the split hopper and method of color blending according to the prior art as explained above. Shown in FIG. 3 is a lower hopper 1 split into two compartments with a baffle plate 2. A single clamshell gate 3 opens the lower hopper and allows material to flow from both sides of the lower hopper 1 simultaneously into the filling tray 4. An agitating grate 5 evens out the material and levels it prior to transferring the material from the filling tray 4 into the mold 10 (not shown). To direct the different color materials to either side of the baffle plate 2 in the hopper 1, an upper hopper 6 is provided as a funnel with a moveable deflecting swing plate 7 operated with pneumatic, electrical or hydraulic cylinder 8 between the positions shown in FIGS. 3 and 4 to fill the two sides of the split hopper 1.

FIG. 4 illustrates the disadvantage in starting up the process since filling the left side of the hopper I when the right side is empty results in an overflowing of material underneath the baffle plate 2 into the right hand chamber as indicated in FIG. 3. It is not desirable to extend the baffle plate 2 downwardly to the clamshell doors 3 since doing so would significantly restrict the flow of material and reduce the speed of production. When the clamshell gate 3 is first opened therefore, the first few fillings of the filling tray 4 consists of the single color that had been deposited first in the left side of the hopper 1. Afterwards, material from both sides of the hopper flows out, however, not at the same rate, since at all times one side of the hopper has more material stored in it than the other side. This results in uneven discharge pressure and uneven distribution of colors throughout the production run.

FIG. 5 illustrates an alternative three color mixing in the prior art system which has proven to be far from ideal, but does result in three colors being deposited into the filling tray 4. Three color mixing involves dumping a third color after swinging the deflecting plate 7 back to the position for filling the left side of the hopper 1. Three color mixing in the prior art requires significant operator skill and careful planning in the sequencing of different colors fed into the upper hopper 6.

Figure 1:
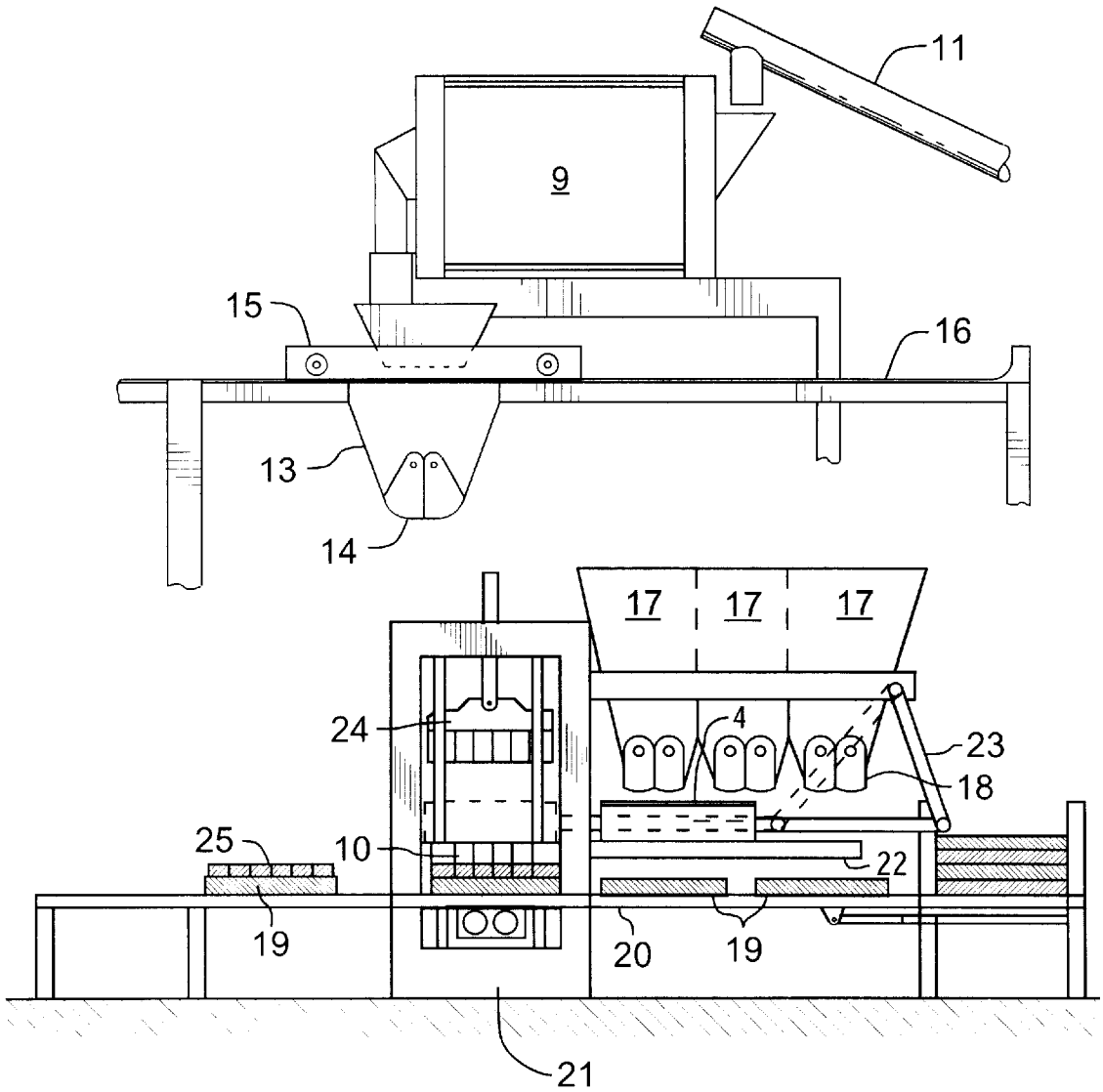
FIG. 1 is a schematic elevation view of an apparatus according to the invention, including from top to bottom in flow direction, a screw conveyor or other means of conveyance that feeds a dry material hopper, a concrete mixer which dumps the completed batch of colored material into a moveable bucket suspended on a wheeled dolly mounted on a runway with clamshell gate at the bottom end, the moveable bucket being able to dump the batch into any one of three material storage hoppers which are positioned with clamshell hopper outlets over a laterally sliding filling tray, the filling tray being moveable laterally from under the storage hoppers to above a mold in a vibrating and tamping press which deposits the finished molded product on pallets conveyed from a pallet stack from right to left through the press to exit with finished molded stones on the top surface.
Figure 2:
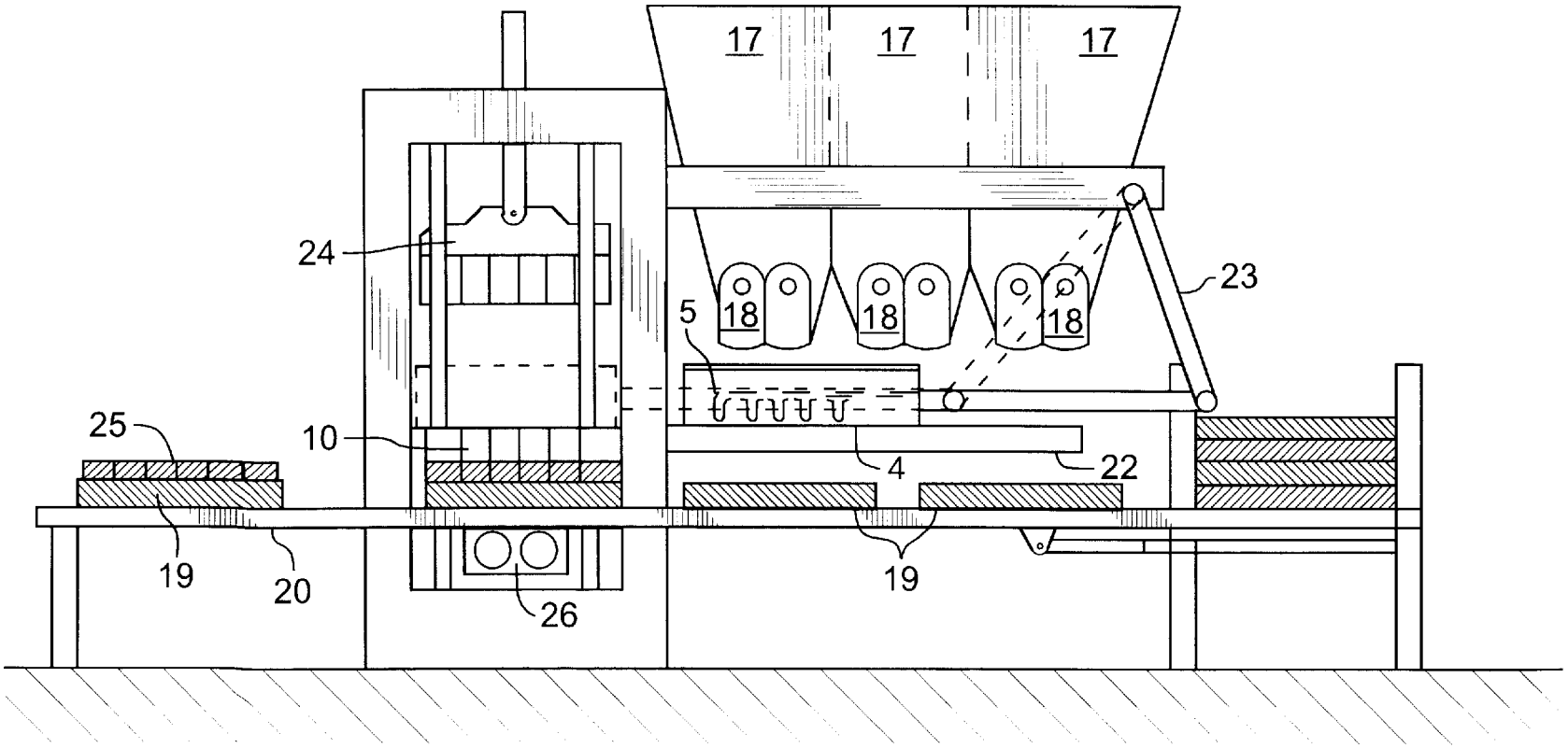
FIG. 2 is a detailed view of the three material storage hoppers, filling tray and press.

To overcome the disadvantages of the prior art, the system shown in FIGS. 1 and 2 is provided as follows.

Referring to FIG. 1, the invention provides for distributing a plurality of selectively colored individual batches of agglomerating flowable material between a mixer 9 and a product forming mold 10. The invention provides that the mold 10 is filled with a mottled heterogeneous charge comprising material from at least two individual colored batches. A significant advantage of the invention is that properly blended products are produced from the first to the last cycle in the production run as opposed to the prior art wherein the first few cycles result in waste material. This feature enables economic production of small runs in response to market demand and in order to reduce inventory.

Further advantage is achieved in that the product is better blended. In the prior art, approximately 25% of the product is produced in a solid color not blended with the other color mixtures. The invention provides a reduction in the number of blocks which are produced with solid color to about 3% with the remaining 97% being blended of two or more colors.

Referring to FIG. 1, the mixer 9 is filled in the conventional manner with cement via a separate cement auger 11 and with aggregates with a travelling dump bin (not shown). Water and other admixtures are mixed with the aggregate and cement for approximately two minutes and then dumped into a moveable bucket 13. The bucket 13 operates between a loading position shown in FIG. 1 in communication with the mixer outlet and a dumping position over a selected hopper 17 below. The moveable bucket 13 includes a clamshell gate 14 at a bottom end and is suspended above the hoppers 17 on a wheeled dolly 15 mounted on a runway 16.

Positioned below the moving bucket 13 and ready to receive the batch of material from the mixer 9 are three material storage hoppers 17, each with an independently operable clamshell outlet 18. Before production commences therefore, three differently colored mixtures are deposited, one in each of the separate hoppers 17 by the moving bucket 13. It will be appreciated that any number of hoppers 17 may be provided, or that the same color may be deposited in two of the hoppers 17 if the chosen color mottling pattern predominates in one color over the other. Downstream of the hoppers 17, below the hopper outlet 18, are means to fill the mold 10 as follows.

Flat empty pallets 19 are conveyed from right to left along a flat conveyor 20 into the molding press 21. The mold 10 is dropped onto the top of the pallet 19 ready to receive wet concrete mixture within the mold 10. A filling tray 4 slides on a table 22 beneath each of the hopper outlets 18 and can be transferred to a mold filling position as shown in dashed outline above the mold 10 with a crank arm 23 or any other equivalent mechanism.

When the filling tray 4 is filled with material exiting from the hopper outlets 18, the filling tray is transferred into the mold press 21. Referring to FIG. 2, vibration of the mold 10 and filling tray 4 with the press vibrator 26 results in downward flow of the material through a grate in the bottom surface of the filling tray 4 into the mold 10. Concrete mixtures with very low slump will not readily exude through the bottom grate, however, under vibration the concrete mixture flows downwardly into the mold 10. After the mold 10 is filled, the filling tray 4 is retracted and the tamping head 24 is lowered on top of the mold to complete the vibration and tamp the top surface of the molded products. Afterwards, the mold 10 and tamping head 24 are retracted upwardly. The conveyor 20 moves the pallet 19 with finished product 25 on the top surface towards the left.

It will be apparent that the described device can also be used where color blending is not required, merely by filling one or more hoppers 17, and utilizing the filling tray as in the prior art.

The advantage of the invention is the ability to fill different hoppers 17 with different colored material and to control the position relative to the mold, time sequencing and quantity of material passed through each hopper outlet toward the mold 10. Control means regulate the opening of the hopper outlets 18, quantity of material flowed out of the hopper 17, and indexing of the tray 4 combined to produce a mottled heterogeneous charge of mixed material from at least two individually colored batches as follows. The empty filling tray 4 can be positioned or indexed with the indexing means such as the crank arm 23 to any selected tray filling position relative to a chosen hopper outlet 18. The tray 4 can slide on the table 22 to receive a quantity of material from any one of the hopper outlets 18 at any desired position. Indexing the filling tray 4 to various positions under different hopper outlets 18 results in filling the filling tray with predetermined quantities of differently colored materials in different positions and in a predetermined time sequence. A computer programmed to control the indexing of the filling tray 4, together with the opening and closing of the hopper outlets 18, therefore, provides control over the position relative to the mold, the time sequencing and quantity of material passed through each hopper outlet in the filling tray 4 and thereafter, directly into the mold 10. As in the prior art, the filling tray 4 includes an oscillating grate 5 to level the material and additionally, distribute the different colors of material within the filling tray. As a result therefore, the invention overcomes the disadvantages of the prior art reducing waste and improving the consistent production of blended patterned product. Freedom to position the filling tray 4 at any position, under any hopper outlet 18 allows control over the blending of different colors from different hoppers 17. The combined freedom of independently opening and closing hopper outlets 18, together with the varying position of the indexable filling tray 4 provides control over the eventual distribution of different colors within the filling tray 4 and thereafter, into the mold 10 directly below the filling tray 4.

Although the invention has been described in respect of only three of hoppers, it can be readily contemplated that the invention also includes any number of hoppers 17, or hoppers with multiple independently operable hopper openings 18, laterally across the filling tray 4. By increasing the number of hoppers 17, or independently operable hopper outlets 18, a greater degree of flexibility in determining the pattern of blending is provided, however, with increased equipment cost.

As will be apparent to those skilled in the art, the invention is not limited to any particular indexing means 23, hopper 17 configuration, conveyor system or mold machine 21 configuration. The drawings and description above relate to one embodiment shown in an almost schematic manner. Molding machines 21 are very expensive high production equipment to replace or modify. The adoption of the invention is more likely if existing equipment can be quickly, easily and inexpensively modified. Therefore the illustrated embodiment does not include substantial modification to the molding machine 21 itself nor to the input and output conveyor system 19, 20. Rather modifications are primarily in the inclusion of multiple hoppers 17, control over the hopper outlet 18, control over the position of the filling tray 4 relative to the hopper outlets 18 and relative timing sequence of tray 4 position and hopper outlet 18 operation.

For example, hopper 17 could be configured in a circular pattern and the filling tray 4 could be indexed by a rotating table. Alternatively, the filling tray 4 itself could be rotated and translated laterally by the indexing means. To those skilled in the art it will be obvious that the design of hopper configuration, tray indexing and other practical features of the invention will often depend on the existing configuration of existing equipment. In newly built facilities of course any configuration can be purchased, however, in practice it is contemplated that most applications of the invention will involve custom design of indexing means and hopper layout to adapt to the layout and operation of existing machinery and existing buildings.

Indexing means can include a simple linear transfer of the tray 4 as illustrated with a crank arm 23 so as to transfer the tray in a horizontal plane. Elevators or lifting platforms may be included in the indexing means to vertically translate, tilt, raise or lower the tray 4. Simple linear transfer, x-y transfer in a plane, rotation, tilting, and vertical transfer can be accomplished with a crank arm 23, hydraulic or pneumatic cylinders, push rods, slides or rails, wheels, linear bearings, rack and pinion drives, worm drives, gear drives, wire cable or chain drive alone or in a pulley system. All such indexing systems can be readily automated and would be within the contemplation of those skilled in the art. Since the present description is addressed to those familiar with mechanical design and material handling, it is considered unnecessary to provide the details of further embodiments utilizing such alternative indexing means, hopper configurations, conveyor systems or molding machines since such alternatives, mechanical or functional equivalents are immediately apparent from the simple example embodiment illustrated and described herein.

Although the above description and accompanying drawings relate to a specific preferred embodiment as presently contemplated by the inventor, it will be understood that the invention in its broad aspect includes mechanical and functional equivalents of the elements described and illustrated.

The embodiments of the invention in which an exclusive property or privilege is claimed are defined as follows:

1. A color blending device for distributing a plurality of selectively colored individual batches of an agglomerating flowable material between a mixer and a product forming mold, the device comprising:

at least two material storage hoppers each with an independently operable outlet;

hopper filling means, disposed between the mixer and the hoppers, for directing an individually colored batch of material from the mixer to a selected hopper;

mold filling means, including a filling tray, downstream from the hoppers, for transferring said material from at least two of the hoppers and for filling the mold with a mottled heterogeneous charge comprising material from at least two said selectively colored individual batches; and control means for controlling the position of the filling tray relative to the mold, time sequencing and quantity of material passed through each hopper outlet into the filling tray, the control means including indexing means for indexing the filling tray to a plurality of selected tray filling positions relative to each hopper outlet and for transferring the filling tray to a mold filling position above the mold.

2. A color blending device according to claim 1 wherein the hopper filling means comprise a movable bucket operable between a loading position in communication with the mixer and a dumping position over a selected hopper.

3. A color blending device according to claim 2 wherein the movable bucket is suspended above the hoppers on a wheeled dolly mounted on a runway.

4. A color blending device according to claim 3 wherein the movable bucket includes a clamshell gate at a bottom end thereof.

5. A color blending device according to claim 1 wherein the filling tray includes material levelling means comprising an oscillating grate.

6. A color blending device according to claim 1 wherein each of the hopper outlets are gated.

7. A color blending device according to claim 6 wherein the hopper outlets comprise clamshell gates.

8. A color blending device according to claim 1 wherein the indexing means are selected from the group consisting of: rotating tables; elevators; lifting platforms; linear, planar, vertical, horizontal and rotational transfer mechanisms including crank arms, hydraulic or pneumatic cylinders, push rods, slides, rails, wheels, sprockets, pulleys, linear bearings, rack and pinion drives, worm drives, gear drives, wire cables, belts and chains.

* * * * *